US005199687A

United States Patent [19]

Maurer

[11] Patent Number: 5,199,687

[45] Date of Patent: Apr. 6, 1993

[54] LIFTING JACK FOR RAILROAD CAR PLATFORM

[76] Inventor: David L. Maurer, 414 W. Howard St., Box 556, Durand, Ill. 61024

[21] Appl. No.: 901,867

[22] Filed: Jun. 22, 1992

[51] Int. Cl.[5] ..... B66F 3/00

[52] U.S. Cl. ..... 254/114

[58] Field of Search ..... 254/113-120

[56] References Cited

U.S. PATENT DOCUMENTS

| | | | |
|---|---|---|---|
| 24,202 | 5/1859 | Durant | 254/114 |
| 202,197 | 4/1878 | Sherman | 254/116 |
| 211,891 | 2/1879 | Dinsmore | 254/116 |
| 287,625 | 10/1883 | Church | 254/114 |
| 676,977 | 6/1901 | Bredehoft | 254/114 |
| 1,405,875 | 2/1922 | Strange | 254/114 |
| 2,332,240 | 10/1943 | Lavalley | 254/116 |
| 3,131,928 | 5/1964 | Whipple | 254/116 |

*Primary Examiner*—Robert C. Watson

*Attorney, Agent, or Firm*—Douglas B. White

[57] ABSTRACT

Generally there is provide herein a manually operated jack for lifting a platform within a railroad car. The device employs a two part telescoping support with a lever member pivotally connected to the lower part. One end of the lever extends for manual operation and the other end is connected to the upper part of the support by a link.

1 Claim, 2 Drawing Sheets

LIFTING JACK FOR RAILROAD CAR PLATFORM

BACKGROUND OF THE INVENTION

1. Field of the Invention

The present invention relates generally to jacks and lifting devices, and more particularly to a device for efficiently lifting with a single stroke a platform within a railroad car known as a "covered tri-level auto rack".

2. Description of the Prior Art

While many lifting devices have been employed in the prior art, none has been presented which efficiently lifts with a single stroke. Moreover, none has been presented which is useable to lift a platform within a railroad car known as a covered tri-level auto rack.

SUMMARY OF THE INVENTION

Generally there is provide herein a manually operated jack which is positioned under a platform within the railroad car to lift the platform. The device employs a two part telescoping support with a lever member pivotally connected to the lower part. One end of the lever extends for manual operation and the other end is connected to the upper part of the support by a link, to cause the upper support to rise in response to downward movement of the lever.

Figure 1:
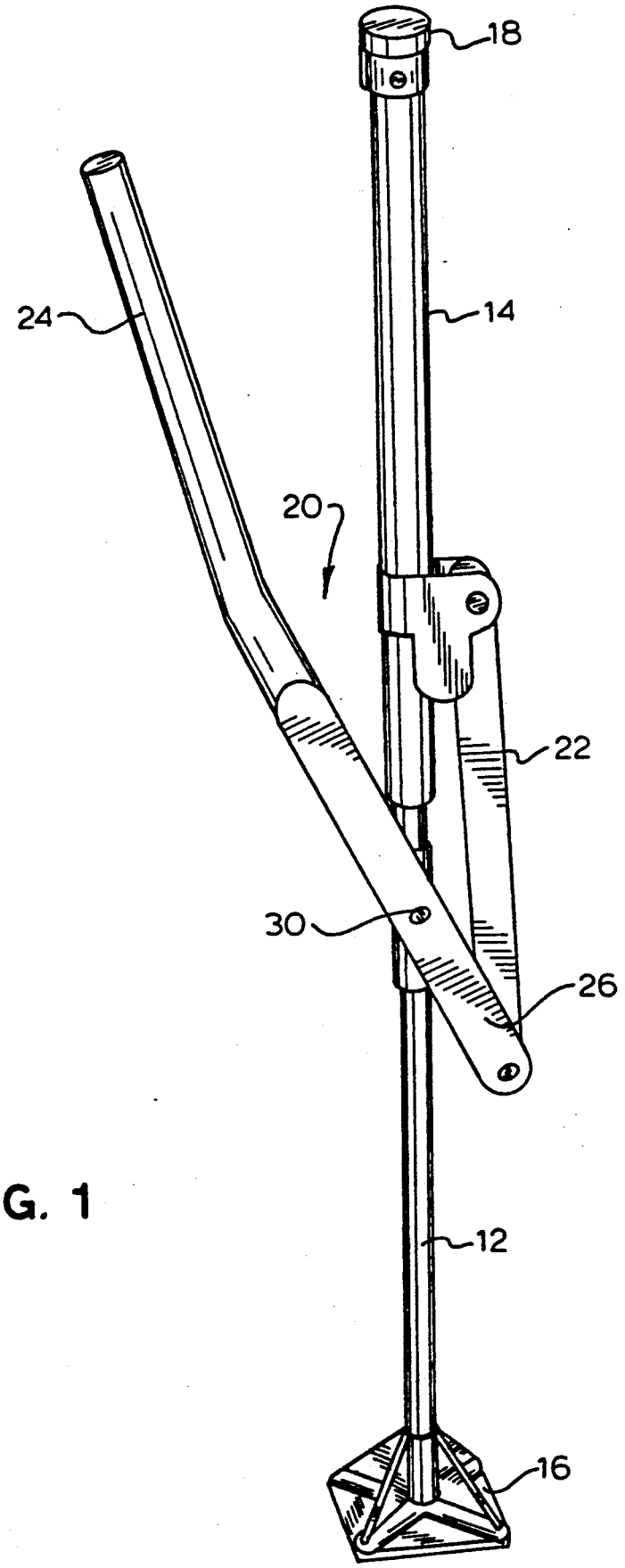
FIG. 1 is a perspective view of the lifting jack of the present invention.
Figure 2:
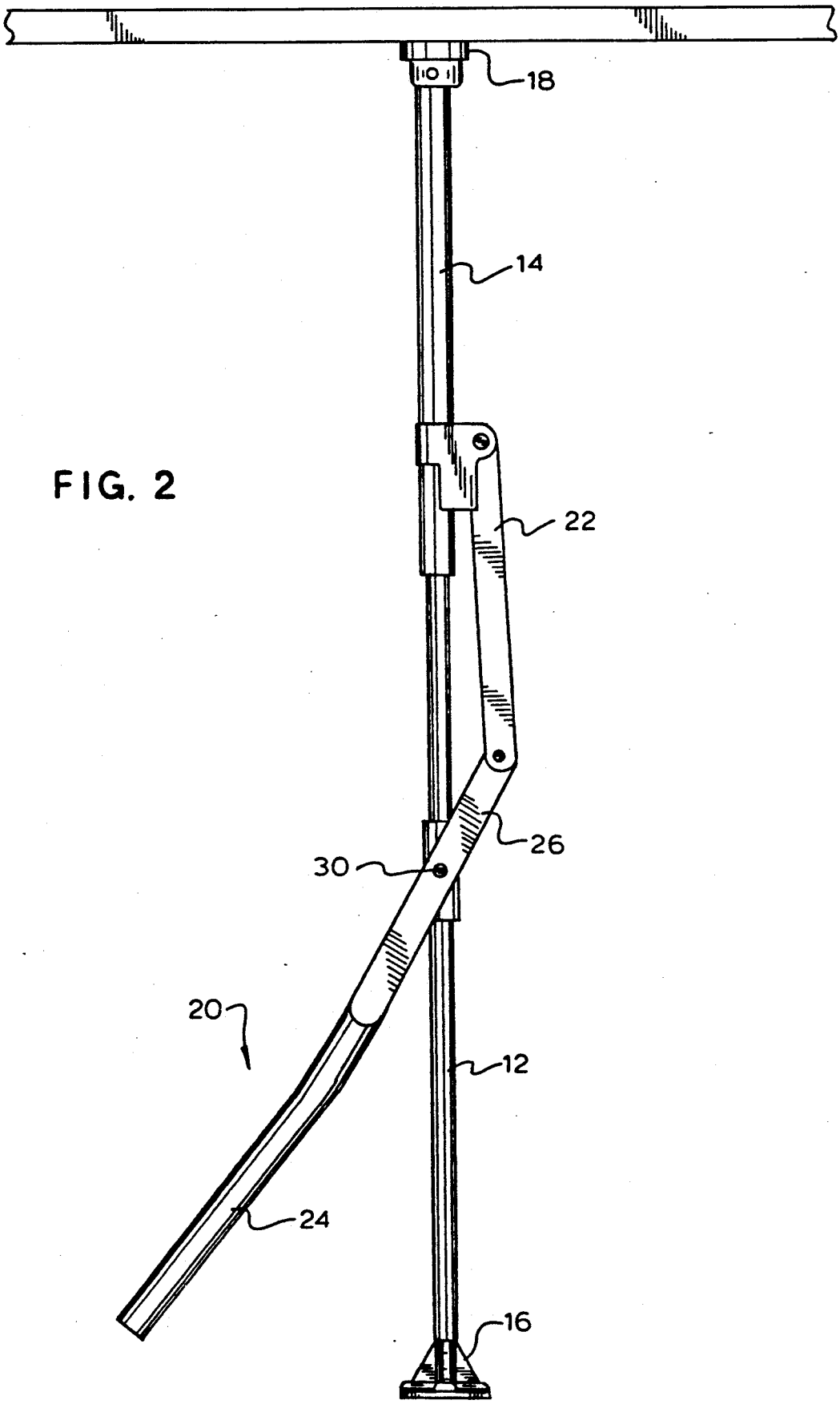
FIG. 2 is a side view of the jack of FIG. 1 shown in an extended position.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning to the figures there is shown a lifting jack in accordance with the present invention for use within railroad cars for the lifting of separating platforms. This jack employs two telescoping sections: a lower support 12 and an upper support 14. A foot 16 anchors the jack, and an upper contact member 18 engages the platform being lifted.

To separate the telescoping sections, a lever arm 20 is pivotally mounted to the lower support and connected to the upper support via linkage 22. Leverage is determined by the difference in the lengths 24 and 26 of the lever arm on either side of the pivot 30. Downward movement of the section 24 of the lever causes section 26 to rise, and through the linkage 22, causes the upper support to rise.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A lifting jack for use within a railroad car for the lifting of separating platforms therein, said jack comprising:

upper and lower telescoping members;

a supporting foot member attached to the lower extremity of said lower telescoping member;

a platform contacting member attached to the upper extremity of said upper telescoping member;

a lever member having an upper and lower portion, said upper portion being angled upwardly from said lower portion, wherein said lever member is pivotally connected at its lower portion to said lower telescoping member at the upper extremity thereof, and wherein said lower portion of said lever member protrudes beyond said pivotal connection for directing lifting force upwardly; and a link connected to the extension of said lower portion of said lever arm protruding beyond said pivotal connection and said upper telescoping member proximate the lower extremity thereof to cause said upper telescoping member to rise in response to downward pressure on the upper portion of said lever member.

* * * * *